United States Patent [19]

Goldfarb et al.

[11] 4,249,334

[45] Feb. 10, 1981

[54] TOY HOVERCRAFT APPARATUS

[75] Inventors: Adolph E. Goldfarb, Tarzana; Delmar K. Everitt, Woodland Hills, both of Calif.

[73] Assignee: Adolph E. Goldfarb, Tarzana, Calif.

[21] Appl. No.: 11,443

[22] Filed: Feb. 12, 1979

[51] Int. Cl.[3] ..... A63H 27/12; A63H 27/14

[52] U.S. Cl. ..... 46/1 J; 46/249

[58] Field of Search ..... 46/1 J, 44, 74 B, 75, 46/249

[56] References Cited

U.S. PATENT DOCUMENTS

| | | | |
|---|---|---|---|
| 3,136,088 | 6/1964 | Crandall | 46/44 X |
| 3,488,882 | 1/1970 | Scott | 46/1 J |

*Primary Examiner*—William A. Cuchlinski, Jr.

*Attorney, Agent, or Firm*—Romney, Schaap, Golant, Disner & Ashen

[57] ABSTRACT

A toy hovercraft apparatus and which includes a toy hovercraft and a launcher therefor. The hovercraft comprises a frame having an outwardly flaring skirt with a downwardly projecting peripheral lip to form an air chamber therebeneath. A motor, e.g., an electric motor, supported centrally of the skirt, rotates a fan located in an upper portion of the chamber to draw in air through inlets and create a pressurized air cushion in the chamber, which, in turn, causes the hovercraft to float or hover over a floor, or other surface. One or more relatively small rechargeable batteries are also carried on the frame and connected to the electric motor for powering the motor and the batteries may be periodically recharged. The hovercraft is preferably round and is constructed so that the weight is symetrically distributed which permits the torque created by the fan to cause rapid rotation of the hovercraft in a level horizontal plane without imparting horizontal motion to the hovercraft. The launcher includes a base for receiving the hovercraft and a manually actuable ejector mechanism for imparting horizontal thrust to the hovercraft to cause it to travel in a generally horizontal path. The hovercraft has no means for imparting motion to itself or changing the direction of motion, but will travel in a generally horizontal path or change direction in response to forces external to the hovercraft which are imparted to the hovercraft. The launcher also includes a source of electrical power and a recharging mechanism which can be coupled to the hovercraft for recharging the batteries in the hovercraft.

26 Claims, 11 Drawing Figures

TOY HOVERCRAFT APPARATUS

BACKGROUND OF THE INVENTION

1. Field of the Invention

This invention relates in general to certain new and useful improvements in toy hovercraft apparatus, and more particularly, to a toy hovercraft apparatus which includes a self-contained toy hovercraft having means for self generating an air cushion to support hovering but no means to impart horizontal motion and direction and a launcher therefor which imparts motion and direction to the toy hovercraft.

2. Brief Description of the Prior Art

There are a number of commercially available passenger-carrying hovercraft of the type which create an air pocket in a skirt portion formed on the underside of the hovercraft. This air cushion supports the hovercraft above a supporting surface such as a body of water, or any other body capable of creating a type of air bearing between the surface and the underportion of the hovercraft. This skirt portion on the hovercraft generally defines a downwardly opening air chamber and a fan or similar mechanism creates sufficient air under pressure to form this air cushion to raise the hovercraft with respect to the supporting surface. In addition, these commercially available hovercraft include means for imparting motion, in a horizontal direction, after the craft has been raised above the supporting surface. Further, the commercially available hovercraft includes a means for guiding i.e., changing the direction of the hovercraft during the course of its travel.

Commercially available hovercraft capable of carrying passengers and/or freight would normally be subjected to a severe torque by the blower means which creates the air cushion which would thereby cause rapid rotation of the hovercraft and this would of course be undesirable. Consequently, the commercially available hovercraft employ some means to counteract the torque which would be caused by the blower. The means to counteract the rotational effects may adopt the form of motor driven propellers which would tend to rotate the hovercraft in a direction opposite that of the torque created by the blower means, or otherwise air ducts which are designed to permit air escapement in a manner to overcome the effects of the torque. In either case a great deal of energy is required to overcome the effects of torque.

There has been a toy hovercraft which included a blower in the form of a fan, but which did not contain any source of power in the toy hovercraft to operate the fan. The user of the toy hovercraft was provided with a hand held assembly which included a motor and which was connected to the fan in the hovercraft by a tube containing a rotatable internal cable capable of causing operation of the fan in the hovercraft. Thus, this type of toy hovercraft was not self contained and hence was limited by the length of the tube and cable arrangement.

There have been self contained toy models of commercial hovercraft, where the model was powered by an internal combustion engine. Such models create fumes and noise, they are difficult to start and operate, and the fuel they burn is dangerous to have around children because of its toxicity as well as its inflammability. Electrical or comparable power avoids such disadvantages, however applicants do not know of a satisfactory self contained toy hovercraft in the prior art. This may be due to certain practical constraints in the design of hovercraft which have not heretofore been overcome. One of the principal problems in developing a self-contained electrically powered toy hovercraft is that the hovercraft itself must include a motor of sufficient size to generate a large enough air cushion in order to support the toy hovercraft. Moreover, the toy hovercraft must also include a source of power for powering the motor. There is a paradox in the design of a toy hovercraft in that the larger the source of power, the larger the motor must be in order to support the weight of the source of power. Accordingly conventional C-type or D-type batteries often used in toy vehicles would add considerable weight to the toy hovercraft thereby requiring the use of a larger motor.

Another problem present in the design of toy hovercraft is the fact that additional motive means required for imparting motion to the hovercraft for movement in a horizontal path may present an added weight and cost to the toy hovercraft. Here again, the motive means which supports the hovercraft over a support surface must be sufficiently large to compensate for the additional weight of the horizontal drive mechanism, as well as any means to give direction to the movement of the hovercraft.

The horizontal drive of the toy hovercraft could be enabled by permitting air from the air cushion to escape at the rear of the hovercraft or otherwise to direct escaping air in a manner to provide a horizontal force to the hovercraft. However, this would still require additional energy and therefore the motor which is used to operate the fan creating the air cushion and the source of power for this motor would still have to be large enough to provide this horizontal momentum. Consequently, the very fact that the hovercraft is capable of providing its own horizontal movement would require a motor considerably larger, and a greater amount of stored electrical energy than a hovercraft which did not require means to provide horizontal movement. If means to provide horizontal momentum were self-contained in the toy hovercraft and the size of the motor and stored energy were not increased than the amount of time that the hovercraft could remain aloft would be sacrificed.

The present invention overcomes these and other problems. The illustrated toy hovercraft is designed so that it is self-contained and of light weight and hovers by a self generated air cushion. The toy hovercraft has symmetrical shape and weight distribution for rapid rotation without generating any horizontal thrust. The hovercraft also has a source of power that may be conveniently rechargeable. Further, there is provided an external launcher mechanism for the hovercraft so that the launcher may impart motion in a horizontal path to the hovercraft.

OBJECTS OF THE INVENTION

It is, therefore, a primary object of the present invention to provide a toy hovercraft apparatus which includes a toy hovercraft capable of supporting itself with respect to a support surface by a self-generated air cushion, and a launcher therefor, which is capable of imparting motion in a generally horizontal path to the toy hovercraft.

It is another object of the present invention to provide a toy hovercraft apparatus of the type stated in which the toy hovercraft carries a motor for rotating a fan to create an air cushion and a rechargeable source of power for the motor, and a recharging mechanism which is capable of being removably coupled to the toy hovercraft to recharge the source of power in the hovercraft.

It is a further object of the present invention to provide a toy hovercraft which includes a skirt and a downwardly projecting lip, along with a fan and source of power therefor to create an air cushion underneath the skirt, and which hovercraft will be self-supporting above the floor, or other supporting surface, and will only have a horizontal movement when a generally horizontal force generated externally of the hovercraft is imparted to the hovercraft and where the horizontal movement of the hovercraft is generally unguided.

It is still another object of the present invention to provide a toy hovercraft of the type stated which includes a main frame comprised of a skirt and a downwardly flaring relatively rigid lip on the periphery of the skirt and which thereby eliminates the necessity of a flexible skirt or lip of the type used on commercial hovercraft.

It is still a further object of the present invention to provide a toy hovercraft of the type stated which is constructed so that it has a symmetrical weight distribution and is capable of rapidly rotating while hovering above a floor or other surface.

It is an additional object of the present invention to provide a toy hovercraft of the type stated which is uniquely designed to present a balance between the desired weight of the hovercraft and the source of power which creates the air cushion self-generated by the hovercraft.

It is another salient object of the present invention to provide a toy hovercraft of the type stated which is relatively durable in its construction and highly efficient in its operation.

It is yet a further object of the present invention to provide a toy hovercraft apparatus of the type stated which is relatively safe, and yet presents a new toy concept, and which is highly amusing and has substantial play value for adults and children.

With the above and other objects in view, our invention resides in the novel features of form, construction, arrangement, and combination of parts presently described and pointed out in the claims.

SUMMARY OF THE DISCLOSURE

A toy hovercraft apparatus which is comprised of a toy hovercraft and a launcher for the hovercraft.

The toy hovercraft is designed for support by a self-generating air cushion so that the hovercraft is capable of generally horizontal low friction movement over the floor or other supporting surface. The illustrated toy hovercraft includes a frame which defines a downwardly opening air chamber. More specifically, the frame includes an upwardly extending central housing, and a skirt extending radially outwardly from the housing. The skirt may be circular in shape and has a downwardly extending peripheral lip which is preferably rigid.

In a preferred form, the upwardly extending housing or otherwise the skirt is broken away to form an enlarged annularly extending opening with the separated portions of the housing or skirt connected by means of a plurality of radially extending ribs. The ribs are spaced apart from each other so that air inlet apertures are formed between the ribs and lead to the downwardly opening air chamber.

The illustrated toy hovercraft also includes a blower means, such as a fan, which is located in the upper center of the chamber. The fan may be powered by a motive means, as for example, an electric motor disposed in the central housing. A source of stored energy, e.g., batteries, to power the motor, may also be carried by the frame, and these batteries are preferably rechargeable. The fan is generally designed to pull air down in through the air inlet apertures formed by the ribs and form a pressurized air cushion in the air chamber. Further, when the fan is operated, some of the air in the air chamber seeps outwardly under the lip and thereby forms an escaping air film which partially functions as an air bearing between the lower edge of the lip and the floor or other supporting surface. In this case, the fan, as powered by the motive means, e.g., electric motor, constitues a means mounted on the frame which is in communication with the air chamber to introduce air under pressure into the air chamber.

The toy hovercraft is preferably self-contained, that is, it does not require connection to an external source of power during operation. Thus, the toy hovercraft includes the frame along with the fan operated by the motor carried by the frame and a source of power also carried by the frame to operate the motor. Since the toy hovercraft does not require any connection to an external source of power, it is capable of self-generating the air cushion for a period of time without the need for a tether, or the like.

The motor is relatively small and light in weight but yet due to the overall light weight of the hovercraft, is able to power the hovercraft for a substantial period of time. The battery is rechargeable and is relatively small and light in weight, thereby further reducing weight requirements for the hovercraft. This construction enables the hovercraft to be maintained in operation for a substantial period of time, at least until the rechargeable batteries are run down.

In this respect, it should be understood that other forms of motive means could be substituted for the electric motor and the source of stored energy as the battery. However, it would be desirable to have a motor which is mounted on the frame and does not require connection to an external device during operation of the hovercraft. Preferably, the motive means is one capable of being operated by a source of stored energy which is capable of being recharged. However, the invention contemplates other motive means.

The toy hovercraft is preferably round and is constructed so that it has a symmetrical shape and symmetrical weight distribution. In this way, the torque created by the blower means causes the hovercraft to rotate rapidly in a level manner while hovering over a floor or other support surface. In this respect, the hovercraft may use a pair of batteries as the source of power for the motor, and the batteries are located in diametrically opposed relationship since they constitute one of the heavier components of the hovercraft and thereby are symmetrical weight distributed. Further, the motor is dynamically balanced in accordance with commercial standards for balanced toy motors. A skirt portion forming part of the frame of the hovercraft may be provided with decorative items, such as light reflector tapes or the like so as to present a rapidly rotating aesthetically pleasing appearance.

Due to the fact that the hovercraft does not have to land in the same manner as commercial hovercraft, and further due to the fact that horizontal motion is not provided with a tilting of the hovercraft away from a level horizontal position, a flexible lip is not required. Thus, the construction of the hovercraft is simplified by the use of a rigid lip on the skirt.

The supporting surface may be the floor, as aforesaid, or any other suitable supporting surface where an air cushion between the hovercraft and the supporting surface will support the hovercraft about that surface. Thus, for example, the supporting surface may adopt the form of a body of water.

The launcher includes a base for receiving the toy hovercraft prior to launching. In addition, a launching means or launcher is associated with the base and is capable of imparting motion to the hovercraft in a generally horizontal direction. Further, a control means is provided for selectively causing the launching means to impart this motion to the hovercraft. In this way, the launcher can provide an initial horizontal force to the hovercraft. The hovercraft itself contains no means for propelling it in a horizontal plane. In absence of any external force for propelling the hovercraft in a horizontal direction, it would generally remain stationary while hovering above a supporting surface. In addition, the hovercraft itself contains no means for changing the direction of movement.

By virtue of the fact that the hovercraft contains no means for propelling itself in a horizontal direction and no means for steering or changing direction, the weight is substantially reduced, thereby permitting the hovercraft to remain aloft for a substantial period of time.

Further, since the hovercraft is supported over a supporting surface through an air cushion and an escaping air film under the lip, there is very little drag or friction energy to overcome, thereby also lending to a substantial operating time of the hovercraft without recharging. The only substantial force which impedes the motion of the hovercraft is that of wind and air friction. Thus, when the hovercraft is launched from the launcher, it can remain aloft and travel in a horizontal plane for a very substantial period of time and hence a substantial distance.

Due to the fact that the hovercraft effectively "floats", any slight horizontal thrust makes it travel in a straight line very rapidly as well as for substantial distance due to low frictional drag. Together with its own rotation which gives it an interesting pleasing optical effect, the hovercraft can travel from one child to another, bounce off obstacles, etc. in a very rapid fashion.

The launching means on the launcher is a generally resilient member which is placed under tension automatically by the hovercraft when the hovercraft is coupled to the launcher. This member under tension engages a portion of the hovercraft, and particularly, the lip thereof, and when released, will propel the hovercraft forwardly. In addition, the amount of tension maintained by the launching member is relatively slight so that there is only a slight initial force imparted to the hovercraft itself. It has been found that it is only necessary to impart a slight horizontal force to the hovercraft to enable travel for a substantial distance since there are relatively few factors which tend to impede its motion. Further, since the hovercraft is capable of operating for a substantial amount of time, it may travel over a substantial distance. The control means forming part of the launching mechanism is a release member, as for example, a release button, and when actuated, will cause the resilient member under tension to push the hovercraft away from the launcher. The launcher may include a support member, e.g., a launching platform to initially provide a direction to the hovercraft when launched.

The hovercraft includes a recharging means on a cap located on the upper end of the housing. This cap also functions as a switch in order to turn the motor off and on. In addition, the launcher itself includes a cooperating recharging means including a source of stored power, as for example, battery power. The recharging means includes a recharging prong capable of being inserted into the recharging means on the cap, as for example, a receptacle on the cap of the hovercraft. The motor is effectively disconnected during the recharging operation so that the motor does not run and thereby use the energy being transferred to the batteries in the hovercraft.

This invention possesses many other advantages and has other purposes which may be made more clearly apparent from a consideration of forms in which it may be embodied. These forms are shown in the drawings accompanying and forming part of the present specification. They will now be described in detail for the purposes of illustrating the general principles of the present invention; but it is to be understood that such detailed descriptions are not to be taken in a limiting sense.

BRIEF DESCRIPTION OF THE DRAWINGS

Figure 1:
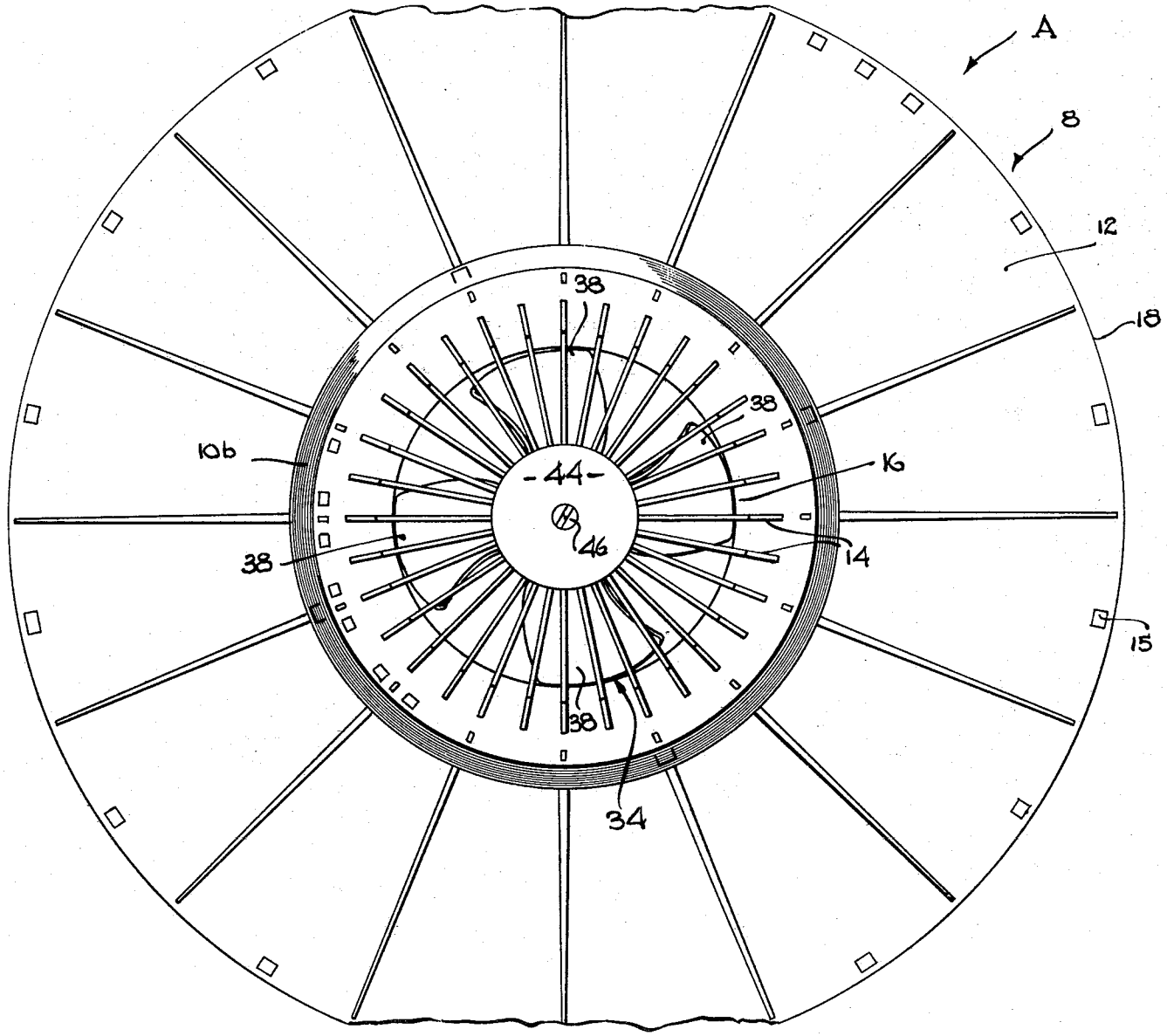
Figure 2:
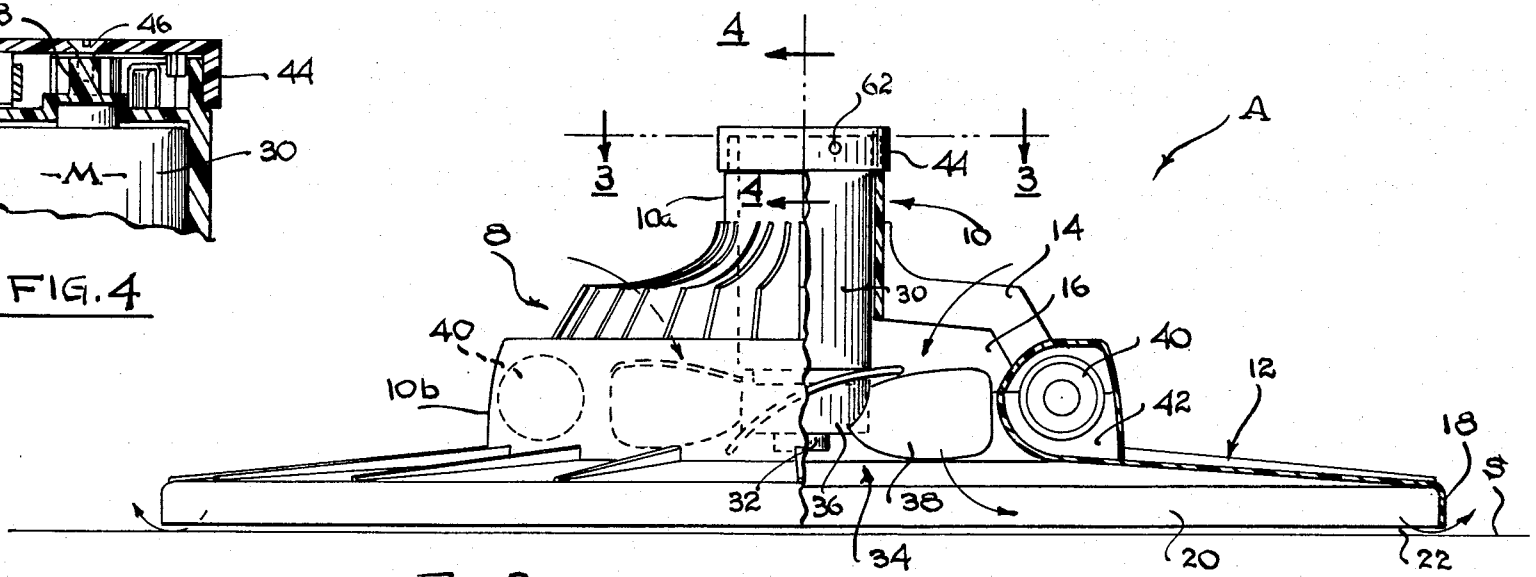
Figure 5:
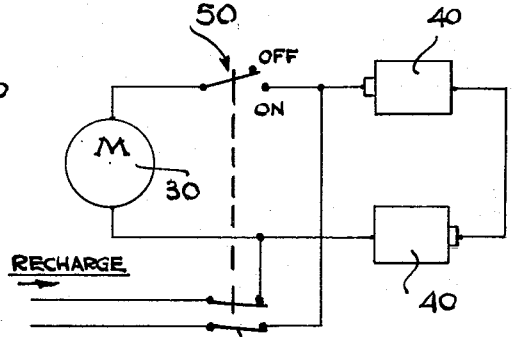
Figure 3A:
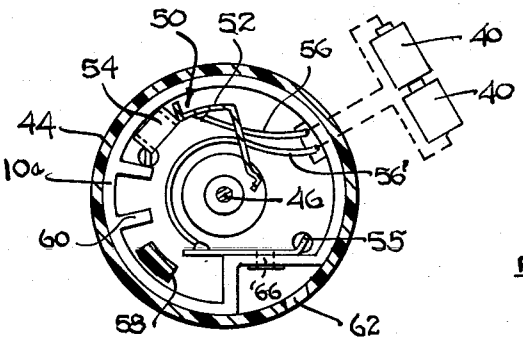
Figure 3:
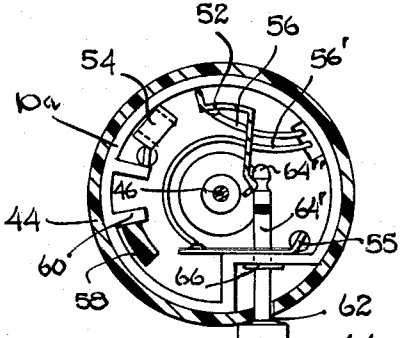
Figure 4:
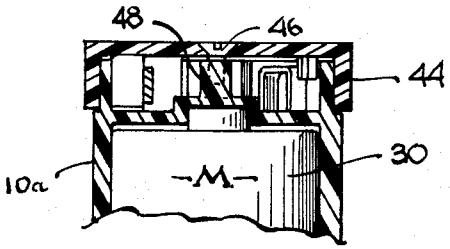
Figure 6:
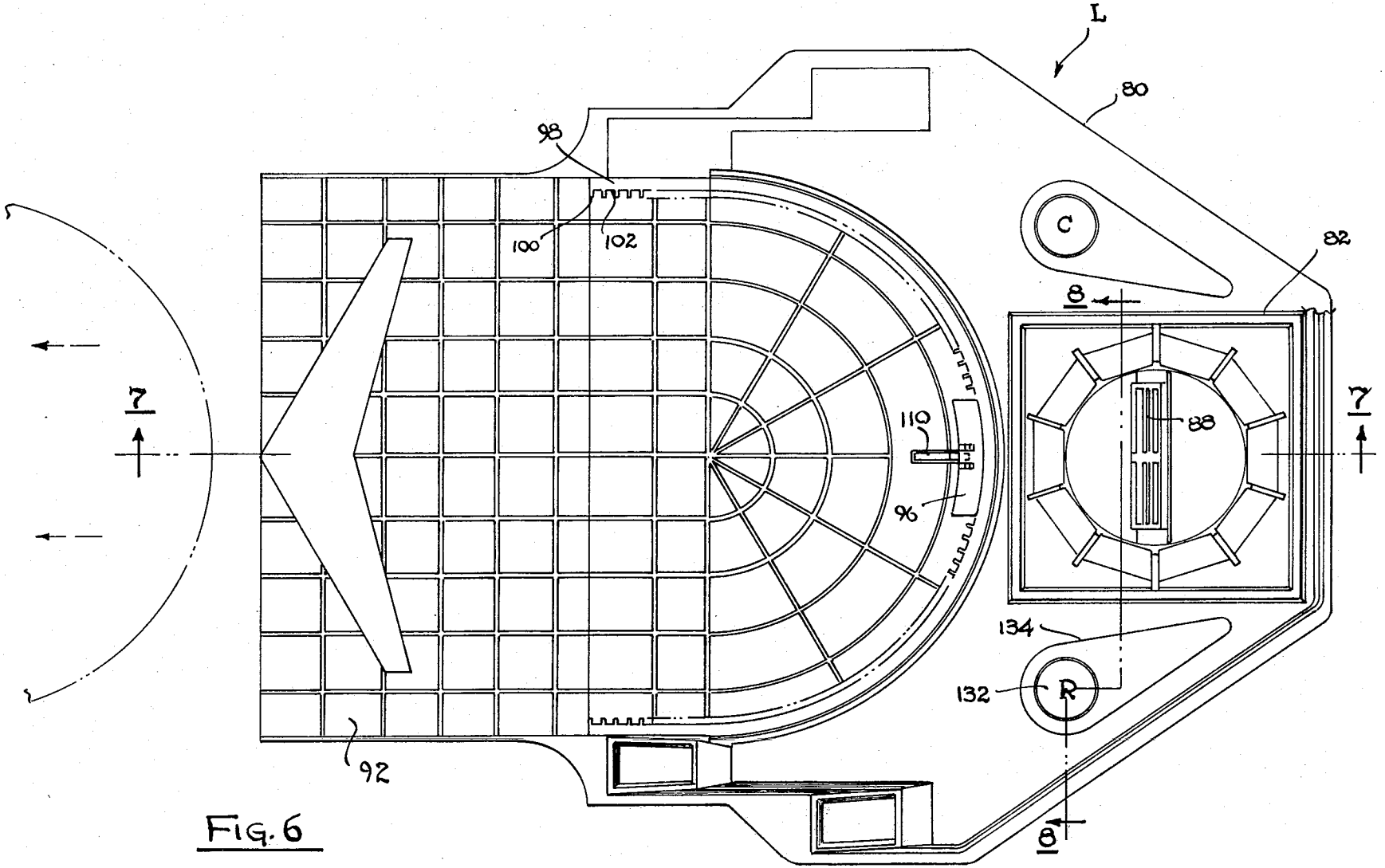
Figure 7:
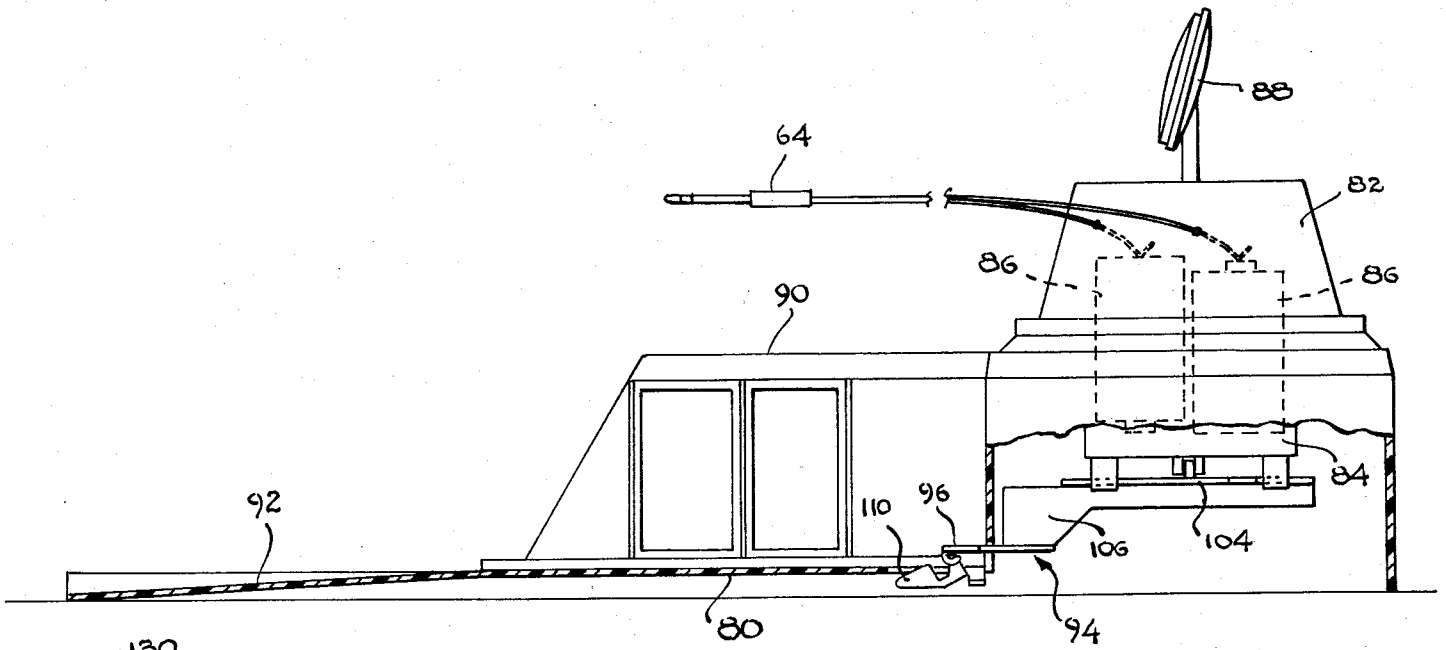
Figure 8:
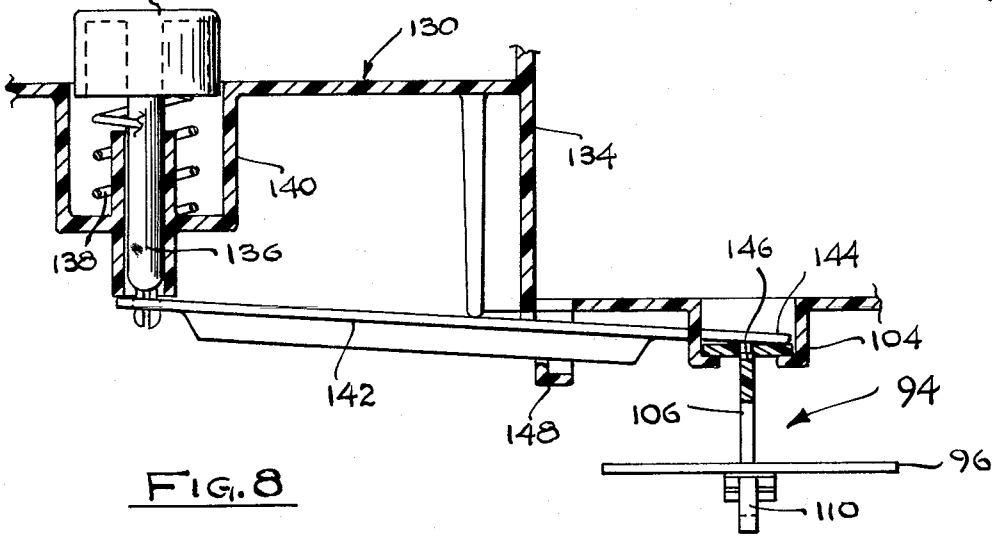
Figure 10:
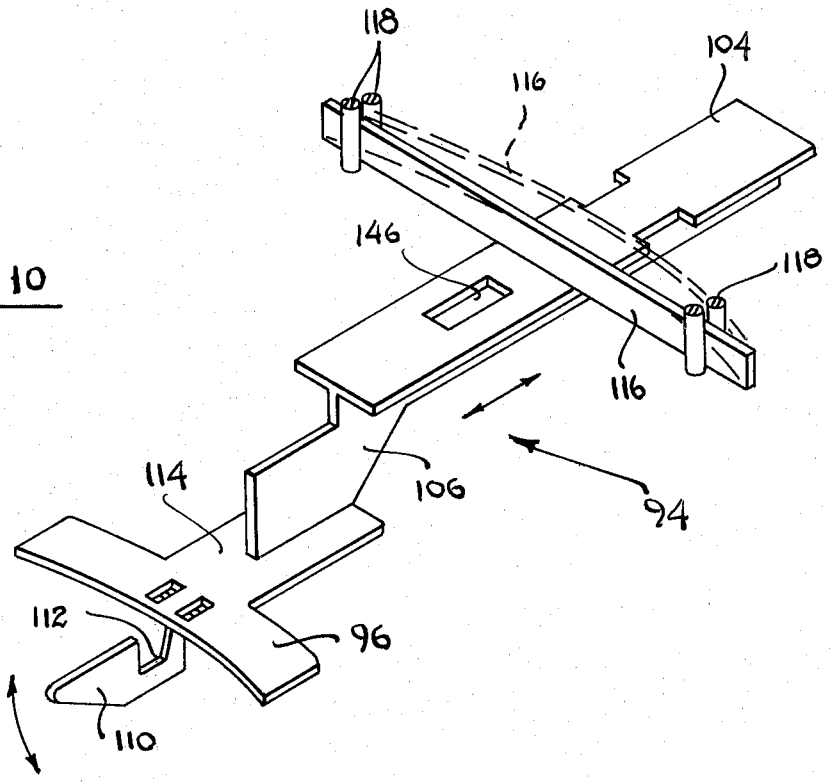
Figure 9:
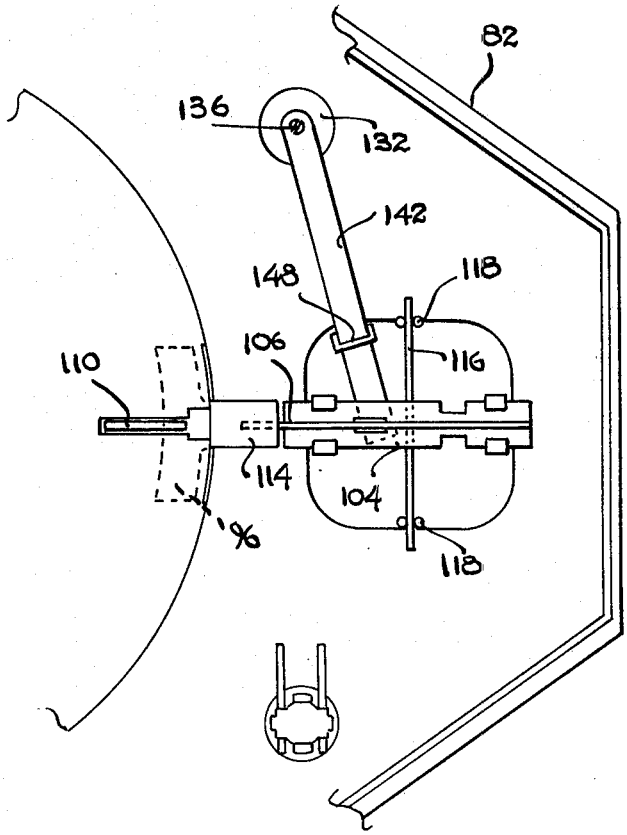

Having thus described the invention in general terms, reference will now be made to the accompanying drawings in which:

FIG. 1 is a top plan view, partially broken away, of a hovercraft forming part of the hovercraft apparatus of the present invention and which is constructed in accordance with and embodies the present invention;

FIG. 2 is a side elevational view of the hovercraft of FIG. 1, partially broken away and in section;

FIG. 3 is a horizontal sectional view, taken along line 3—3 of FIG. 2;

FIG. 3A is a view similar to FIG. 3 but having a cap and switch mechanism in a different position;

FIG. 4 is a fragmentary vertical sectional view, taken along line 4—4 at FIG. 2;

FIG. 5 is a schematic circuit view showing a portion of the circuit in the hovercraft of FIGS. 1–4;

FIG. 6 is a top plan view of the launcher forming part of the toy hovercraft apparatus of the present invention and which is constructed in accordance with and embodies the present invention;

FIG. 7 is a vertical sectional view, taken substantially along line 7—7 of FIG. 6;

FIG. 8 is a vertical sectional view taken substantially along line 8—8 of FIG. 6;

FIG. 9 is a bottom plan view, partially broken away and showing a portion of the release mechanism forming part of the launcher of FIGS. 6–8; and FIG. 10 is a perspective view of a launching and release mechanism forming part of the launcher of FIGS. 6–9.

DETAILED DESCRIPTION OF A PREFERRED EMBODIMENT

Referring now in more detail and by reference characters to the drawings which illustrate a preferred embodiment of the present invention, "A" designates a toy hovercraft which is more fully illustrated in FIGS. 1–5 and "L" designates a toy launcher which is more fully illustrated in FIGS. 6–10.

The toy hovercraft "A" generally comprises a main frame 8 having a centrally located and upwardly extending tubular housing 10 comprised of a first tubular housing section 10*a* and an enlarged housing section 10*b* in the form of a diametrically enlarged hub. By referring to FIG. 2, it can be seen that the hub 10*b* is surrounded by an outwardly flaring, generally circular skirt 12, which is inclined slightly downwardly from the horizontal. The skirt 12 is actually a plate like member and is often referred to as a "top wall".

The housing 10 is provided with an enlarged annularly extending opening with a plurality of radially extending circumferentially spaced apart ribs 14 spanning this opening. Thus, in actuality the tubular housing section 10*a* is effectively connected to the housing section 10*b* by means of a plurality of the radially extending ribs 14 which are separated by apertures 16, the latter defining air-inlet apertures. The ribs 14 may be integral with the upstanding housing 10 and the skirt 12, or otherwise they may be separately formed and joined together by means of adhesives or the like. The skirt 12 is also provided with a plurality of reflectors or other form of decorative decals 15.

The major components of the hovercraft, except for a motive means e.g. a drive motor and a source of power, as hereinafter described, are preferably made of a light-weight plastic. For example, the housing, along with the ribs 14 and the skirt 12, could be made as a unitary structure in a conventional molding operation and may be formed of a well-known plastic, such as polyethlene, or polystyrene, various urethanes or the like. However, it should be understood that the components could be formed separately and secured together by means of suitable adhesives, or the like as stated above. Further, the housing could be made of various reinforced plastic material, such as fiberglass epoxy resin composites, or other suitable materials.

Secured to the outer edge of the skirt 12 is a downwardly struck lip 18, thereby forming an air chamber 20 defined by at least the skirt 12 and the lip 18 along with a supporting surface designated as "S". The lip 18 is often referred to as a peripheral side wall means. In this case, the supporting surface may be any type of surface which permits an air cushion to be formed under the skirt 12 and within the lip 18, as previously described. Further, when the hovercraft is operated, it will be slightly spaced upwardly from the surface "S" thereby forming an air bearing space 22 between the lower edge of the lip 18 and the surface "S".

As indicated previously, the toy hovercraft of the present invention is capable of self-generation an air cushion within the chamber 20, thereby supporting suspension above the surface "S". However, it can also observed that the hovercraft "A" has no means for propelling itself in a horizontal direction. Further, the hovercraft "A" has no means for guiding so as to change direction.

Suitably mounted within the upstanding housing 10 is a conventional motive means, e.g., an electric motor 30 which causes FIGS. 2 and 3 of the drawings. A blower means in the form of a fan 34 comprised of a hub 36 is mounted on the lower end of the drive shaft 32, in the manner as illustrated in FIG. 2 and a plurality of blades 38 extend outwardly from the hub 36. When the fan is rotated through energization of the motor 30, it will cause air to be drawn through the openings 6 and into the air chamber 20. Any suitable conventional form of fan or propeller may be employed for this purpose. In the same respect, the term "fan" is used in a broad sense, as indicated above, to include any blower means for introducing air through the openings 16 and into the air chamber 20. In this same connection, it should be observed that the ribs 14 are relatively thin in cross section so as to permit a relatively large air flow in through the openings 16 and into the chamber 20. The ribs 14 are nevertheless sufficient in structural integrity to provide necessary structural rigidity.

The motor 30 is preferably a suitable battery-operated electric motor, and which is operable by batteries 40 mounted within battery compartments 42 formed on the upper portions of the skirt 12. While not specifically illustrated, the compartments 42 are provided with an openable and closable member so as to provide access for purposes of changing the batteries when necessary. Further, the batteries 40 are connected to the motor by means of electrical wires hereinafter described in more detail.

The batteries are preferably relatively small and are designed to be rechargeable. Batteries of this type are typically small, round batteries. However, the batteries 40 are sufficient to rotate the electric motor 30 for a substantial period of time, due to the fact that the motor 30 is also relatively small and requires little stored energy for rotation. The battery compartments serve as battery retaining means.

Referring to FIGS. 3, 3A and 4, a cap 44 is provided on the upper end of the housing 10. The cap 44 which may be rotatably retained as by means of a screw 46 which extends into an upwardly projecting hub 48 on the housing. The cap 44 is rotatable in order to operate as a part of a switch 50 to turn the motor 30 on and off. The switch 50 is schematically illustrated in FIG. 5 and, as shown in FIGS. 3 and 3A, is comprised of a movable switch contact 52 and a fixed switch contact 54. The fixed contact 54 is secured to the interior side wall of the housing. The fixed contact 54 comprises one terminal of the motor. The movable element 52 may be mounted on and movable with the cap 44. Moreover, it will be observed that two conductors 56 and 56' are connected to the batteries 40. One of the conductors 56 is connected to the movable contact 52 and the other conductor 56' is connected to element 55 which comprises the other terminal of the motor.

By rotating the cap 44 in the counter-clockwise direction to the position shown in FIG. 3A, the movable contact 52 engages the fixed contact 54 to energize the motor 30. When the cap 44 is rotated in the clockwise direction, the movable contact 52 is moved out of engagement with the fixed contact 54 so that the motor 30 is de-energized.

A depending lug 58 on the cap 44 is engageable with an inwardly projected stop 60 on the side wall of the housing 10 when the cap is rotated to the furthest position in the clockwise direction. The furthest position of the cap 44 when rotated in the counter-clockwise direction is defined when the contact 52 engages the contact 54.

In one embodiment of the illustrated toy hovercraft, the motor was manufactured by Mabruchi of Japan Model No. 260-2295, had an overall size of about one inch in length (height in the arrangement illustred in FIG. 2 of the drawings) and a diameter of about 15/16 inch. Further, the motor had a weight of about 28 grams. An alternate motor which may be employed is that made by the Johnson Company under Model No. 340-23. The batteries employed were the so-called "toy cell" batteries of the General Electric Company and were nickel-cadmium batteries. Each of the batteries had a diameter of about 0.55 inches and a thickness, e.g., axial dimension, of about 0.63 inches and delivered 1.25 volts each or a total of about 2.5 volts. Furthermore, each of the batteries had a weight of about 9.9 grams. The skirt in the hovercraft in the above embodiment had an overall size of about 8¾ inches and the hovercraft had an overall height of about 2¾ inches and a weight of less than one third pound including motor and batteries.

The hovercraft is provided with a receptacle for receiving a recharging prong 64 that is connected to a recharging mechanism. The receptacle is made up of a hole 62 in the cap 44 and a hole 66 in an offset portion of the housing wall. The holes 62 and 66 are aligned as shown in FIG. 3 when the motor 30 is off, so as to receive the prong 64 which makes electrical contact with the batteries. When the motor is on, the holes 62 and 66 are out of alignment as shown in FIG. 3A so that the prong 64 cannot be inserted into hole 66 and will not make electrical contact with the batteries. In this way, the recharging mechanism can only be connected to the batteries when the motor is off.

The recharging prong 64 comprises an outer conductive pin 64' and concentrically located inner-conductive pin 64", one serving as the positive conductor and the other serving as the negative conductor. When the prong 64 is in the receptacle, the outer pin 64' is in electrical contact with element 55 and conductor 56', and the inner conductive pin 64" is in electrical contact with the movable contact 52 and the conductor 56.

In accordance with the above outlined construction, it can be seen that the cap 44 actually becomes part of a switch such that a separate switch is not required for operation of the motor. In addition, the cap effectively operates to disconnect the motor from the batteries during the recharging operation. FIG. 3 shows the prong 64 extending into the housing during recharging and FIG. 3A shows the cap rotated so that the motor would be running.

As indicated previously, the toy hovercraft can remain aloft for a fairly substantial amount of time before recharging is necessary. Generally the time of operation that is the time in which the toy hovercraft may remain aloft, is related to the time of recharging. Generally with the arrangement of batteries and motor employed in the preferred embodiment, there is a two to one recharging rate such that the amount of time the hovercraft can remain aloft is about twice the amount of time used in recharging. Thus, if the batteries are recharged for a period of about one minute, then the time of operation is about two minutes. The batteries of the toy hovercraft are designed so that given the construction of the toy hovercraft, it can remain in operation for a very substantial amount of time, e.g. fifteen minutes or so if the batteries are overchanged. However, overcharging of the batteries could reduce the lifetime of the same.

In accordance with the above outlined construction, it can be seen that the hovercraft is preferably circular in shape. Due to the fact that the skirt is generally circular, the hovercraft will receive less damage and cause less damage when it impacts or engages any object. The toy hovercraft is constructed so that there is a substantially symmetrical configuration and substantially symmetical weight distribution about the axial vertical centerline passing through the hovercraft. As indicated previously, the batteries are located in diametrally spaced apart relationship on opposite sides of the axial vertical centerline. In this way, the hovercraft will adopt a generally horizontal attitude while it is hovering. This horizontal attitude will permit the hovercraft to remain level, and will prevent any of the energy from being used to generate a horizontal thrust which might result if the hovercraft were not level, that is tipped relative to the horizontal. In addition, because the hovercraft adopts a level attitude the torque energy created by the fan will not be consumed in providing horizontal movement and will cause the hovercraft to rotate rapidly. This rapid rotation is highly aesthetically pleasing, particularly with aesthetic markings on the upper surface of the skirt. In addition, if the hovercraft should come into contact with any surface it will tend to move along the surface due to its rotation and the generally continuous peripheral (circular) margin, rather than stall in the position of contact. Further, this construction will prevent it from veering off in a particular direction.

As indicated previously, the hovercraft itself contains no means for imparting horizontal motion or for guiding itself. While, to some extent, this horizontal motion could be provided from the self-generated air cushion, that is by tilting the hovercraft, other means would be necessary in order to effectively impart any horizontal motion. This additional means, which would rely upon the self-generated air cushion to impart such horizontal movement, would only increase the overall weight of the hovercraft and thereby reduce the effective operating time. Further, the design of the hovercraft would have to be altered considerably to enable it to use the self generated air cushion to provide horizontal movement. Thus, in accordance with the construction of the illustrated embodiment, all of the energy which is used in the operation of the blower means effectively is used to support the hovercraft over the support surface and to cause rotation of the same.

A launcher L, which is used with the hovercraft A of the present invention, is more fully illustrated in FIGS. 6–10 of the drawings. The launcher L generally comprises a base plate 80 having an upstanding rectangularly shaped housing 82 integrally formed at the rearward end thereof. The housing 82 is internally provided with a battery support plate 84, and the latter of which is designed to removably support a pair of batteries 86, such as conventional flashlight-type batteries, typically 1.5 volt batteries. These batteries 86 serve as the source of power for recharging the batteries 40. At its upper end, the housing 82 may be provided with decorative items, such as a simulated antenna 88, or the like.

It should be understood that the launcher would include suitable conductors connected to the batteries 86. Further, the prong 64 would be connected to the other end of the conductors for connection to the hovercraft A for purposes of recharging the batteries in the hovercraft. Further, it should also be understood that the recharging means need not be included in the launcher as shown in the illustrated embodiment. Thus, the recharging means could be a separate member having a source of stored energy, e.g., C or D cell batteries for connection to the batteries in the hovercraft.

Also extending upwardly from the base 80 is a wall 90 which adopts somewhat of a U-shaped configuration and extends around the rear margin and portions of the opposed longitudinal margins of the base 80. Further, extending from the forward end of the base 80 is a somewhat downwardly inclined ramp 92, which is only slightly angulated downwardly from the horizontal in the manner as illustrated in FIG. 7 of the drawings. The base 80 and the ramp 92 could serve as an initial support surface for the hovercraft as it is initially launched. It should be understood, however, that the launcher need not provide a horizontal support as such. In this respect, the ramp 92 actually serves to provide some initial direction to the hovercraft in that the base 80 and ramp 92 may have a grid imprinted on their upper surfaces, along with an arrow in the manner as illustrated in FIG. 6 of the drawings, although these latter elements are merely decorative in nature.

The plate 84 sits above and is secured to a launching means 94 in the form of an ejector mechanism, hereinafter described in more detail and which is shiftably located within the housing 82. Furthermore, the lauching means 94 includes an extending lip 96 which extends outwardly and forwardly of the housing 82, in the manner as illustrated in FIG. 6 and 7 of the drawings.

The wall 90 includes an inwardly extending support flange 98 for supporting and engaging the lip 18 of the hovercraft prior to launching. Thus, the flange 98 actually serves as a support means on the base for supporting the hovercraft prior to launching. Further, the flange 98 which is somewhat semi-circular in shape, as illustrated in FIG. 6 of the drawings, includes a plurality of inwardly projecting fingers 100 thereby forming spaces 102 therebetween. Moreover, the flange 98 is spaced slightly upwardly from the base 80 as well as the ramp 82, thereby permitting a slight air space underneath the hovercraft. In this way, the hovercraft can create an air cushion in the air chamber 20 and permit the air to extend through the spaces 102. In this way, the hovercraft can create the necessary air pressure in order to maintain its horizontal stability when launched and urged in a horizontal direction.

The ejector mechanism 94 is more fully illustrated in FIGS. 9 and 10 of the drawings and comprises a flat support plate 104 and which includes a downwardly extending tap 106, the latter of which retains the forwardly extending engagement lip 96. By reference to FIG. 10 it can be observed that the engagement lip 96 is arcuately shaped and has a curvature approximately equal to the rim of the hovercraft A. Moreover, an outwardly struck finger 110 is pivotally secured to and extends forwardly of the engagement lip 96 and includes a groove 112 therein. This finges 110, as well as the groove 112 formed therein, comprises a hook means which initially prevents the horizontal shiftable movement of the hovercraft A until it is actually released by the operator. The recess or notch 112 is designed to engage the downwardly struck lip 18 on the hovercraft A and thereby retentively hold the same. Moreover, the hook 110 is mounted such that it will engage the lip 18 of the hovercraft A, but when shifted downwardly, will release the lip 18 of the hovercraft A such that the hovercraft is released.

The hook 110 functions as a latch and is pivotally mounted within a slot 114 formed in the engagement lip 96. Further, the latch 110 is pivotally shiftable in a somewhat vertical plane as represented by the arrow in FIG. 10. The ejector 94, can be shifted to the "cocked" or actuated position when the hovercraft A is placed on the launcher for ultimate launching, by pushing rearwardly with the lip of the hovercraft against the ejector mechanism. As this occurs, a somewhat resilient, transversely extending bar 116 mounted on the plate 104 will be biased rearwardly to an energized position, in the manner as illustrated in the phantom lines of FIG. 10. Furthermore, the transversely extending bar 116 is captured between opposed pairs of pins 118, also in the manner as illustrated in FIGS. 9 and 10 of the drawings. This bar 116 is relatively thin and functions as a resilient member under tension when the mechanism is in the cocked position. As this occurs, the entire mechanism will be shifted rearwardly and retained in the cocked position for ultimate launching of the hovercraft A.

The ejector 94 is permitted to shift forwardly and thereby cause the hovercraft to move in a generally horizontal direction, by means of a release mechanism 130, more fully illustrated in FIGS. 8 and 9 of the drawings. In this case, the release mechanism comprises a manually actuatable release push button 132 mounted within an upstanding boss 134 in the manner as illustrated in FIGS. 6 and 8 of the drawings. The release button 132 is mounted on a vertically disposed rod 136 and is spring biased upwardly by means of a compression spring 138 located within a recess 140 formed within the upstanding boss 134. The release button 132 and the associated mechanism (hereinafter described in more detail) constitutes a control means which permits selective release of the launching means to cause motion of the hovercraft.

At its lower end the vertically disposed shaft 136 bears against a transversely extending link 142 which has a release arm 144 extending into an aperture 146 formed within the plate 104. The link arm 142 is retained by a stirrup 148 in the manner as illustrated in FIGS. 8 and 9 of the drawings. In this way, when the push button 132 is pushed downwardly, the link 142 will pivot in a somewhat counter-clockwise direction, reference being made to FIG. 8. As this occurs, the release arm 144 will be removed from the aperture 146 thereby permitting the ejector mechanism 94 to shift forwardly. The latch 110 will then be permitted to drop such that the hovercraft will be released.

Thus, there has been illustrated and described a unique and novel hovercraft apparatus including a toy hovercraft having the capability of maintaining an airborn position for a substantial period of time with a small source of stored energy and a launcher therefor. Thus, the present invention fulfills all of the objects and advantages sought therefore. It should be understood that many changes modifications, variations, and other uses and applications will become apparent to those skilled in the art after considering this specification and the accompanying drawings. Therefore, any and all such changes, modifications, variations, and other uses which do not depart from the spirit and scope of the invention are deemed to be covered by the invention which is limited only by the following claims.

Having thus described the invention, what is claimed is:

1. A toy hovercraft apparatus comprising:

(a) a toy hovercraft adapted to be supported on a self-generated air cushion for generally horizontal movement over a floor or other surface, said toy hovercraft comprising:

(1) a frame, (2) means on the frame defining a downwardly open air chamber, said chamber defining means having top wall means and peripheral side wall means extending generally downwardly from said top wall means, and (3) means mounted on said frame and in communication with said air chamber to introduce air into said chamber, and (b) a launcher for said hovercraft comprising:
(1) a base,
(2) means on said base for generally maintaining said hovercraft in a ready position prior to launching,
(3) launching means associated with said base capable of imparting force to said hovercraft to cause it to move in a generally horizontal direction, and
(4) control means for selectively causing said launching means to impart said movement to said hovercraft.

2. The apparatus of claim 1 further characterized in that said launching means of said launcher provides only slight horizontal thrust to said hovercraft and which hovercraft generally follows a path of movement provided by said launcher and where a change in the path of movement of said hovercraft after launching is caused by a force external to said hovercraft.

3. The apparatus of claim 1 further characterized in that said launcher is provided with a somewhat horizontally disposed platform.

4. The apparatus of claim 1 further characterized in that said launcher comprises a latch which initially engages said peripheral side wall means of said hovercraft, said latch being operatively connected to said control means for becoming disengaged from said peripheral side wall means to enable said launcher to impart said movement to said hovercraft.

5. The apparatus of claim 1 further characterized in that said peripheral side wall means extends generally downwardly from the outer edge of said top wall means.

6. The apparatus of claim 1 further characterized in that the means to introduce air into the chamber includes a fan means and power means operatively connected to said fan means to provide power to said fan means.

7. The apparatus of claim 6 further characterized in that said power means is battery powered and said frame of said toy hovercraft is provided with means to permit recharging the batteries for said power means.

8. The apparatus of claim 1 further characterized in that said apparatus is provided with cooperating recharging means for engaging the recharging means of said hovercraft and provides stored energy to said hovercraft.

9. The apparatus of claim 1 further characterized in that the means to introduce air into said chamber of said hovercraft includes:
(a) fan means;
(b) electric motor means for powering said fan means; and
(c) means for holding a source of battery power for powering said electric motor means, and recharging means being provided on said frame for enabling recharging said source of battery power, said launcher further comprising:
(1) a means for holding a source of stored electrical energy;
(2) recharging connection means capable of being operatively connected to said source of stored electrical energy, and being adapted for connection to said recharging means on said hovercraft for recharging the source of battery power in said hovercraft.

10. The apparatus of claim 9 further characterized in that said hovercraft is provided with a switch to turn said electric motor means on and off and said switch being coupled to said recharging means on said hovercraft to prevent recharging of the source of battery power when said switch is turned to the on position.

11. A self contained toy hovercraft for self-supported generally horizontal unguided movement over a floor or other surface, said hovercraft comprising:
(a) a somewhat circular disk-like member.
(b) a downwardly projecting lip at or in proximity to the prephery of said disk-like member forming a downwardly opening air chamber,
(c) an upwardly extending housing at or in proximity to the center of said disk-like member,
(d) fan means communicating with said air chamber for introducing air into said chamber so that an air cushion can be created under said disk-like member which supports said hovercraft above said floor or other supporting surface, and
(e) electric motor means in said housing for powering said fan means so that said hovercraft will remain above said floor or other supporting surface when said fan means is operating,
(f) battery retaining means associated with said housing to receive a battery for powering said electric motor means, and
(g) recharging means operatively associated with said housing for receiving an electrical conductor carrying an electric current and which recharging means permits operative connection between said electrical conductor and a battery during recharging thereof.

12. The toy hovercraft of claim 11 further characterized in that said toy hovercraft is used with a device comprised of:
(a) a source of stored electrical energy, and
(b) recharging means operating connected to said source of stored electrical energy, and being adapted for connection to the said recharging connection means on said hovercraft for recharging a battery in said hovercraft.

13. The toy hovercraft of claim 11 further characterized in that the toy hovercraft will remain generally at one location until a force generated external of said hovercraft is applied to said hovercraft.

14. The toy hovercraft of claim 13 further characterized in that said hovercraft will travel in a horizontal path or generally horizontal path when a generally horizontal force generated externally of said toy hovercraft is imparted to said hovercraft and where movement is said horizontal path is unguided by said hovercraft.

15. The toy hovercraft of claim 11 further characterized in that said lip is a rigid element.

16. The toy hovercraft of claim 11 further characterized in that said upwardly extending housing is provided with a plurality of ribs which connect said housing to said disk-like member and which ribs are separated by air floor apertures which permit said form to pull air through said aperture and direct same into said air chamber.

17. A self-contained toy hovercraft for self-supported generally horizontal unguided movement over a floor or other surface, said hovercraft comprising:
(a) a plate-like member;
(b) a downwardly projected lip at or in proximity to the periphery of said plate-like member forming a downwardly opening air chamber;

(c) fan means associated with said plate-like member and communicating with said air chamber for introducing air into said chamber so that an air cushion can be created under said plate-like member and with air escaping between said lip and the floor or other supporting surface which supports said hovercraft above said floor or other supporting surface;

(d) an upwardly extending housing at or in proximity to the center of said plate-like member, said upwardly extending housing provided with a plurality of ribs, which ribs are separated by air flow apertures which permit said fan means to pull air through said apertures and direct same into said air chamber; and, (e) electric motor means in said housing for powering said fan means so that said hovercraft will remain above said floor or other supporting surface and will only have horizontal movement when a generally horizontal force generated externally of said toy hovercraft is imparted to said hovercraft and where said horizontal movement is unguided by said hovercraft.

18. The toy hovercraft of claim 17 further characterized in that said lip is a rigid element.

19. The toy hovercraft of claim 17 further characterized in that said lip is a rigid element and said plate-like member is circular.

20. The toy hovercraft of claim 17 further characterized in that said hovercraft is dynamically balanced to have a generally symetrical weight distribution.

21. A self-contained toy hovercraft for self-supported generally horizontal unguided movement over a floor or other surface, said hovercraft comprising:

(a) a plate-like member;

(b) a downwardly projected lip at or in proximity to the periphery of said plate-like member forming a downwardly opening air chamber.

(c) an upwardly extending housing at or in proximity to the center of said plate-like member;

(d) fan means associated with said plate-like member and communicating with said air chamber for introducing air into said chamber so that an air cushion can be created under said plate-like member and with air escaping between said lip and the floor or other supporting surface which supports said hovercraft above said floor or other supporting surface;

(e) electric motor means in said housing for powering said fan means so that said hovercraft will remain above said floor or other supporting surface and will only have horizontal movement when a generally horizontal force generated externally of said toy hovercraft is imparted to said hovercraft and where said horizontal movement is unguided by said hovercraft;

(f) battery retaining means associated with said housing to receive a battery for powering said electric motor means; and, (g) recharging means operatively associated with said housing to permit recharging of said battery.

22. The toy hovercraft of claim 21 further characterized in that said hovercraft is provided with a switch to turn said electric motor means on and off and said switch being coupled to said recharging means to prevent recharging of the battery means when said switch is turned to the on position to permit said motor means to be energized.

23. A self-contained toy hovercraft for self-supported generally horizontal movement over a floor or other surface, said hovercraft comprising:

(a) a frame having a plate-like member and a downwardly projected lip at or in proximity to the periphery of said plate-like member forming a downwardly opening air chamber, (b) fan means on said frame and communicating with said air chamber for introducing air into said chamber so that an air cushion can be created under said plate-like member which supports said hovercraft above said floor or other supporting surface, said frame being provided with an upwardly extending housing and a plurality of ribs which connect said housing to said plate-like member and which ribs are separated by air flow apertures which permit said fan means to pull air through said apertures and direct same into said air chamber; and, (c) electric motor means on said frame for powering said fan means so that said hovercraft will remain above said floor or other supporting surface said fan means and electric motor means being arranged so that said hovercraft is substantially symmetrical in weight distribution, said hovercraft only having a horizontal movement when a generally horizontal force generated externally of said toy hovercraft is imparted to said hovercraft and where said hovercraft rapidly rotates when hovering.

24. The toy hovercraft of claim 23 further characterized in that said horizontal movement is unguided by said hovercraft.

25. The toy hovercraft of claim 23 further characterized in that said plate-like member and said lip are circular in shape.

26. A self-contained toy hovercraft for self-supported generally horizontal movement over a floor or other surface, said hovercraft comprising:

(a) a frame having a plate-like member and a downwardly projected lip at or in proximity to the periphery of said plate-like member forming a downwardly opening air chamber;

(b) fan means on said frame and communicating with said air chamber for introducing air into said chamber so that an air cushion can be created under said plate-like member which supports said hovercraft above said floor or other supporting surface;

(c) electric motor means on said frame for powering said fan means so that said hovercraft will remain above said floor or other supporting surface said fan means and electric motor means being arranged so that said hovercraft is substantially symmetrical in weight distribution, said hovercraft only having a horizontal movement when a generally horizontal force generated externally of said toy hovercraft is imparted to said hovercraft and where said hovercraft rapidly rotates when hovering;

(d) battery receiving means associated with said frame for receiving a battery to power said electric motor means; and (e) recharging means operationally associated with said frame to permit recharging of said battery.

* * * * *